United States Patent [19]

Kuparinen

[11] 4,207,012

[45] Jun. 10, 1980

[54] INK COMPENSATING CHAMBER FOR SCRIBER

[75] Inventor: Lasse Kuparinen, Hamburg, Fed. Rep. of Germany

[73] Assignee: Koh-I-Noor Rapidograph, Inc., Bloomsburg, N.J.

[21] Appl. No.: 866,591

[22] Filed: Jan. 3, 1978

Related U.S. Application Data

[63] Continuation-in-part of Ser. No. 725,618, Sep. 22, 1976, Pat. No. 4,095,907.

[30] Foreign Application Priority Data

Sep. 25, 1975 [DE] Fed. Rep. of Germany ... 7530355[U]
Sep. 25, 1975 [DE] Fed. Rep. of Germany ..... 2542734

[51] Int. Cl.[2] ..... B43K 5/18

[52] U.S. Cl. ..... 401/258; 401/225; 401/242

[58] Field of Search ..... 401/225, 227, 229, 230, 401/258–259, 242

[56] References Cited

U.S. PATENT DOCUMENTS

| | | | |
|---|---|---|---|
| 2,795,211 | 6/1957 | Nichols | 401/242 X |
| 3,306,267 | 2/1967 | Matsumoto | 401/258 |
| 3,594,092 | 7/1971 | DiCarlo | 401/258 |
| 3,824,023 | 7/1974 | Danjczek et al. | 401/258 |
| 3,905,709 | 9/1975 | Bok | 401/258 X |

FOREIGN PATENT DOCUMENTS

| | | | |
|---|---|---|---|
| 2159942 | 6/1973 | Fed. Rep. of Germany | 401/258 |
| 2160835 | 6/1973 | Fed. Rep. of Germany | 401/258 |
| 2216015 | 10/1973 | Fed. Rep. of Germany | 401/258 |

*Primary Examiner*—Edward M. Coven
*Attorney, Agent, or Firm*—David H. Semmes; Warren E. Olsen

[57] ABSTRACT

A capillary writing pen of the type having an expansion or compensation chamber intermediate the ink reservoir and ambient air. The expansion chamber is improved such that inadvertent flowing of ink from the reservoir to the capillary pen tip due either to pressure or temperature changes is avoided. The interior wall of the expansion chamber is profiled as a contiguous series of transverse indentations which extend circumferentially about the tubular pen body to provide successive expansion areas for entrapment of air and constrictive areas where menisci of ink are formed. The forming of the menisci entraps air bubbles within the ink and, accordingly, provides increased resistance to capillary flow of ink.

6 Claims, 3 Drawing Figures

INK COMPENSATING CHAMBER FOR SCRIBER

CROSS-REFERENCES TO RELATED APPLICATIONS

The present application is a continuation-in-part of applicant's U.S. application Ser. No. 725,618 entitled Cover For Scriber, filed Sept. 22, 1976, which is now U.S. Pat. No. 4,095,907. The present application is directed to the species of FIG. 3 which was a non-elected species in response to a restriction requirement, as disclosed in the parent U.S. application.

The present application is based upon applicant's earlier filed West German applications, as follows:

| Serial No. | Filing Date |
|---|---|
| P 25 42 734.3 | September 25, 1975 |
| G 75 30 355.8 | September 25, 1975 |

BACKGROUND OF THE INVENTION

1. Field of the Invention

The invention relates to an India ink compensating chamber for capillary drafting pens. The compensating chamber serves as an expansion chamber between the India ink reservoir within the pen and the surrounding air.

The India ink compensating chamber in the case of capillary drafting pens in the event of an increase of inside pressure, absorbs India ink within an inside bore and/or within the India ink reservoir, such that India ink will not be forced out of the capillary writing tip due to excessive pressure. Furthermore, ambient air reaches the inside bore and the India ink reservoir by way of the India ink compensating chamber, whenever an underpressure develops in said reservoir due to consumption of India ink or a lowering of ambient temperature.

2. Description of the Prior Art

West German As No. 1,561,857
OS No. 2,216,015
OS No. 1,911,950

The conventional spiral-shaped India ink exchange chambers forming a capillary (German AS, No. 1,561,857, German OS No. 2,216,015) have well fulfilled the aforementioned tasks per se and are used at the present time in varied types of capillary drafting pens. It is true, however, that these India ink compensating chambers, due to their capillary shape, as well as the necessarily fine capillaries formed on the edges of the compensating chambers, as a result of the attaching thread and pen cover, are inclined to force the ink out of the reservoir and forwardly into the compensating chamber, that is to say underfined capillary forces develop.

These previously known India ink compensating chambers have moreover the disadvantage that only a single border surface is formed between the India ink and the air, which, in case of an aeration or expansion process, must be removed. The size of the meniscus radius forming in the ink within the compensating chamber and thus the resistance in case of aeration or expansion process is given as the result of the geometrical cross-section of the India ink compensation chamber. This resistance is very slight in the case of the previously known systems. Also, it is not possible to increase this resistance by decreasing the cross-section of the India ink compensation chamber, since capillary forces then occur, as a result of which the India ink is sucked into the India ink compensation chamber, that is to say the resistance becomes even slighter.

SUMMARY OF THE INVENTION

Therefore, it is an object to the present invention to create a progessively acting India ink compensating chamber with a high resistance against the undesired and uncontrolled leakage of India ink.

According to the invention, the appropriate resistance is achieved with an India ink compensating chamber of the conventional type, modified so that in at least one portion of the India ink compensating chamber, its cross-sectional profile changes several times in the direction of axial flow between a maximum and a minimum value and as an insurance preferably periodically, whereby the minimum value lies in the capillary range.

This change of the cross-sectional profile can be achieved due to the fact that a limiting surface of at least one part of the India ink compensation chamber in the direction of axial flow and in horizontal cross-section has the shape of an undulatory line, expecially an undulatory line having a triangular profile.

In an India ink compensation chamber developed in such a way, one will achieve several menisci, that is to say several border surfaces will form between India ink and ambient air, whenever the India ink in the India ink compensation chamber is forced away from the India ink reservoir, so that the India ink will fill successively areas of constricted and expanded cross-sectional profile defined within the ink expansion chamber. In the areas of an expanded cross-sectional profile, air customarily remains enclosed. The above-mentioned additional ink menisci will form, thusly, between this air in the areas of expanded cross-section and the areas of decreased cross-sectional profile. As a result of this additional number of menisci, that is border surfaces, the resistance to aeration and resistance to expansion of the India ink through unwanted axial flow towards the writing tip will be increased.

By properly dimensioning the distances between the adjacent cross-sectional surfaces with a minimal value, it will be possible to influence the shape of the menisci, that is to say to produce flattened menisci which contribute to a further increase of the resistance.

An India ink compensation chamber has also been known already (German OS No. 1 911 950), which has been provided only on a part of the periphery of the cylindrical body and which interconnects the India ink reservoir with the ambient air by way of an opening in the front end of the pen. This India ink compensation chamber therefore does not run spirally or meander-shaped around the periphery of the cylindrical body but in zig-zag form and only over a portion of the periphery of the cylindrical body.

Starting out from such an India ink compensating chamber of the present invention, a preferred embodiment consists of a series of contiguous indentations transversally disposed within the wall of the cylindrical body in a generally circumferential direction, so that the variable areas of cross-sectional surfaces formed by the indentations run always vertically with respect to the longitudinal axis of the cylindrical body and are defined in a meandering path, encircling the body.

The invention will be explained in more detail in the following drawings showing the embodiments in a schematic and simplified way.

DESCRIPTION OF THE PREFERRED EMBODIMENTS

Figure 1:
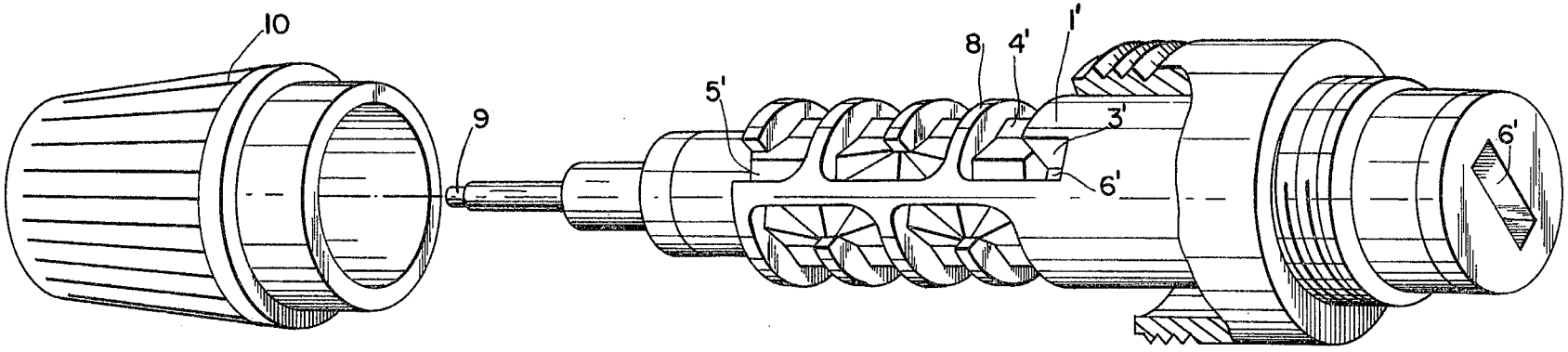
FIG. 1 is an exploded perspective, partially in section, showing a pen nib, with cap removed, according to the invention.

FIG. 1 shows a part of the cylindrical body 1 into which a capillary writing tube, 9, is inserted at the front or bottom and which has an inside bore 6' being connected with the India ink reservoir, likewise not shown, into which inside bore a conventional falling weight, with cleaning wire extending forwardly to capillary tube 9, may be inserted.

Cylindrical body 1' is surrounded in a sealing manner by a casing or cap 10, which is secured in a known manner onto the cylindrical body 1'.

Figure 3:
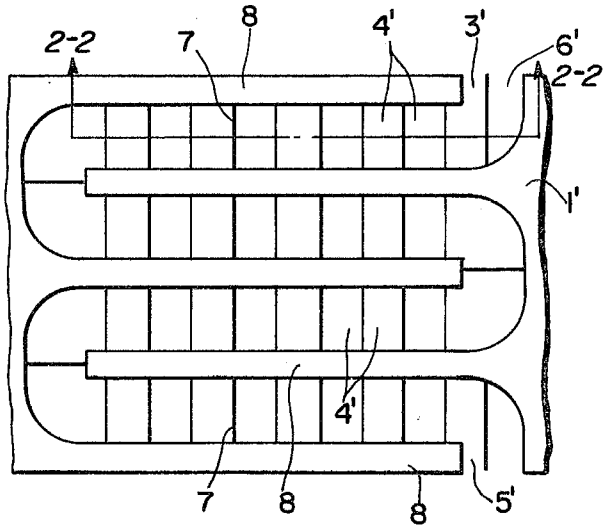
FIG. 3 is a fragmentary side plan and exposed view with cap removed of an ink compensation chamber according to the invention.
Figure 2:
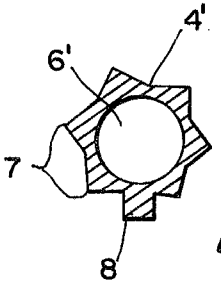
FIG. 2 is a transverse section, taken along section line 2—2 of FIG. 3, showing the series of contiguous indentations forming the India ink compensation chamber and provided in the cylindrical body of the pen.

In the wall of cylindrical body 1' a series of contiguous indentations have been provided which form the India ink compensation chamber 4' which at the front or bottom, is connected via port 5' with ambient air and in the rear by way of an opening 3' with the inside bore 6' and thus with the India ink reservoir. The inner profile of the India ink compensation chamber 4' is formed as a series of transverse paths, superposed with respect to each other in the direction of flow and encircling the exterior of cylindrical body 1' whereby this partial encircling may be also identified as in a circumferentially extending direction. The cross sectional profile of these paths is defined as a series of triangular waves, whereby the individual indentations and elevations developed as a result of this profile run substantially axially, as is shown in FIGS. 1 and 3 and, therefore, perpendicularly to the direction of flow of India ink in the compensation chamber 4'. One will achieve by this profile of the inner surface of the India ink compensation chamber 4', that the depth and thus the cross-sectional profile of the India ink compensation chamber 4' changes in the direction of ink flow periodically between a maximum and a minimum value. At the same time, the minimum value is within the capillary range.

The India ink flowing through the India ink compensation chamber 4' and the air, thus flow essentially in a meandering path within the capillary writing pen through the India ink compensation chamber 4' and the desired large volume of this India ink compensation chamber is achieved by the corresponding variations in cross section of the chamber.

The India ink flows forwardly through the finest capillaries formed between cover 10 and cylindrical body 1' at the edges of the India ink compensation chamber and as a result it fills successively those interstices between the triangular elevation and cap 10 which serves as a cover between the elevations, so that menisci of India ink develop. Cap 10 may be secured to the pen body by conventional means, such as a threaded coupling.

It is therefore quite easily understandable that at the narrowest cross-sectional profile of the India ink compensation chamber 4' places of constriction in flow develop in which air bubbles passing through them are "stretched" and, possibly, supported by the sharp-edged or wave development of the inner profile. Such bubbles may thusly be split, so that there will be an assurance that no agglomerations of air bubbles into a large and no longer moveable air volume will result.

In FIG. 3 it will be seen that ink compensating chamber 4' first runs transversely in one direction about the periphery of the cylindrical body, then axially downwardly into a connecting transverse channel which runs transversely in an opposite direction, and then again axially downwardly to another transverse chamber which proceeds in an opposite direction and so on. As the unwinding or exploded view in FIG. 3 shows, in the inner wall of ink compensation chamber 4' an undulating wave profile is developed such that there are elevations 7 between alternating indentations. The areas of the India ink compensation chamber running transversely are always separated from one another by separating walls 8.

As a result of this construction the finest capillaries are formed between cover 10 and the series of indentations 4' which conduct India ink to the elevated areas 7. The India ink flows because of capillary effect into the elevated middle areas 7 of the India ink compensating chamber and forms plural menisci of India ink adjacent these elevated areas 7, so that therefore a considerable resistance in series against the entry of the India ink into the India ink compensation chamber exists, as well as on the other hand the air bubbles moving through the India ink compensating chamber are "stretched" and split, so that an agglomeration of air bubbles into an immovable, large volume of air will be prevented.

I claim:

1. In a capillary writing pen of the type having an ink reservoir communicable with a writing tip, the improvement comprising:

(A) an expansion chamber interconnecting the reservoir and ambient air as a capillary channel apart from the writing tip and having an inner and outer wall for the flow of ink;

(i) said expansion chamber comprising at least two circumferentially extending and interconnecting chamber portions, each portion having an inner wall comprising contiguous indentations which extend axially such that, in cross-section, a triangular wave profile is defined with respect to the outer wall of said circumferentially extending chamber portions, said at least two chamber portions being interconnected, in the axial direction, by means of an axially aligned connecting channel, whereby said indentations define, within said capillary channel, successive areas of expansion and constriction, such that ambient air is entrapped in the areas of expansion and menisci of ink are formed in the areas of constriction, and perpendicularly to the flow of ink within said chamber.

2. A capillary writing pen as in claim 1, said inner wall of said expansion chamber being formed in the exterior of a writing pen body and said outer wall being formed by means of a cover surrounding said writing pen.

3. A capillary writing pen as in claim 2, wherein said axially aligned connecting channel also includes an inner wall having indentations which defines a triangular wave profile, therein.

4. A capillary writing pen as in claim 3, said expansion chamber at one end communicating with ambient air via a port adjacent the writing tip of said pen and said expansion chamber at its other end communicating with the ink reservoir.

5. A capillary writing pen as in claim 4, said expansion chamber end communicating with the ink reservoir at a point axially spaced from said end communicating with ambient air.

6. A capillary writing pen, as in claim 1, wherein said expansion chamber further runs circumferentially, in a first transverse direction, from an end communicating with said reservoir to a first peripheral point, then axially downwardly through said connecting channel and then transversely, in a direction opposite to said first transverse direction to a second peripheral point, then axially downwardly, and so forth, in a meandering fashion, to said writing tip.

* * * * *